US007265678B2

(12) United States Patent
Chapman, Jr. et al.

(10) Patent No.: US 7,265,678 B2
(45) Date of Patent: Sep. 4, 2007

(54) SYSTEM AND METHOD FOR REMOTELY CONTROLLING LOW BATTERY WARNINGS FOR SMOKE DETECTORS AND THE LIKE

(75) Inventors: John Gilman Chapman, Jr., Delaware, OH (US); Nicholas Ashworth, Dublin, OH (US); Robert Burt, Columbus, OH (US); Timothy E. Wallaert, New Hudson, MI (US); Kevin Ernest Noesner, Dublin, OH (US)

(73) Assignee: Maple Chase Company, Carol Stream, IL (US)

( * ) Notice: Subject to any disclaimer, the term of this patent is extended or adjusted under 35 U.S.C. 154(b) by 170 days.

(21) Appl. No.: 11/031,573

(22) Filed: Jan. 6, 2005

(65) Prior Publication Data

US 2005/0151636 A1 Jul. 14, 2005

Related U.S. Application Data

(60) Provisional application No. 60/535,281, filed on Jan. 8, 2004.

(51) Int. Cl.
*G08B 21/00* (2006.01)

(52) U.S. Cl. ..... 340/636.11; 340/636.1; 340/628; 340/636.19; 340/286.05

(58) Field of Classification Search ..... 340/636.11, 340/636.1, 628, 639, 691.4, 540, 286.05, 340/636.19

See application file for complete search history.

(56) References Cited

U.S. PATENT DOCUMENTS 5,594,422 A * 1/1997 Huey et al. ..... 340/628
5,686,896 A * 11/1997 Bergman ..... 340/636.1
5,969,600 A * 10/1999 Tanguay ..... 340/438
6,624,750 B1 * 9/2003 Marman et al. ..... 340/506

* cited by examiner

*Primary Examiner*—Benjamin C. Lee
*Assistant Examiner*—Travis R. Hunnings
(74) *Attorney, Agent, or Firm*—Reinhart Boerner Van Deuren P.C.

(57) ABSTRACT

An intelligent thermostat communicates with battery-powered threat detectors, such as smoke detectors, to allow remote quieting and coordination of a low battery warning detected by the threat detector. In one embodiment, the threat detector transmits a pre-warning signal to the thermostat indicating that a low battery condition is imminent. The thermostat uses this information to display a pre-warning to the consumer so that the consumer may better coordinate replacing of the battery at a convenient time. Once a low battery condition has been detected, the threat detector transmits a low battery warning signal to the thermostat. The thermostat then displays a warning message and an option for the consumer to quiet the chirping for a period of time from the thermostat. Preferably, the thermostat automatically quiets the chirping during quite times so as to not disturb the consumer.

20 Claims, 3 Drawing Sheets

SYSTEM AND METHOD FOR REMOTELY CONTROLLING LOW BATTERY WARNINGS FOR SMOKE DETECTORS AND THE LIKE

CROSS-REFERENCE TO RELATED PATENT APPLICATIONS

This patent application claims the benefit of U.S. Provisional Patent Application No. 60/535,281, filed Jan. 8, 2004, the teachings and disclosure of which are hereby incorporated in their entireties by reference thereto.

FIELD OF THE INVENTION

The present invention relates generally to battery-powered threat detector battery monitoring and warning systems, and more particularly to an appliance control system that allows remote control of battery-powered threat detector low battery warnings.

BACKGROUND OF THE INVENTION

Recognizing the lifesaving benefits of smoke and other threat detectors, more and more consumers are installing these devices in their homes. Indeed, many municipalities have enacted building ordinances that require that smoke detectors be installed in new construction and in order to sell an existing home. Apartment buildings and other commercial structures typically also include such smoke detectors. While many commercial structures and many newly constructed single-family dwellings include centrally powered smoke detectors, i.e. powered from the main electrical system of the dwelling, almost all other smoke detectors installed by consumers are battery powered. Indeed, many centrally powered smoke detectors still include a backup battery so that the benefits of the detector are not lost during a power outage.

Unfortunately, while the life saving benefits of the smoke detectors cannot be discounted, such smoke detectors continue to be a source of annoyance at times for consumers. One source of annoyance results from the fact that most smoke detectors are installed on the ceiling or otherwise in a location that is not easily accessible by the average consumer without using a stepladder. Since many such smoke detectors are battery powered as discussed above, these batteries periodically need to be replaced. While most manufacturers recommend that the consumer periodically test the smoke detector to make sure that the batteries are still operational, many consumers do not follow these recommendations based primarily on the difficulty of reaching the smoke detector test button.

Recognizing that consumers often do not follow the manufacturer's recommendations for periodically testing the smoke detectors, most modern smoke detectors include battery monitoring circuitry. This battery monitoring circuitry determines the remaining charge left in the battery, and provides an audible indication, typically a periodic chirp, to alert the consumer that the battery in the smoke detector is nearly discharged. Unfortunately, this chirp can often occur at inconvenient times for the consumer, such as during the middle of the night, during dinner, etc. Since this chirping will continue until the consumer replaces the battery or until the battery is fully discharged and is no longer functional, such a feature, while critical to the maintenance of the lifesaving ability of the smoke detector, is very annoying to consumers.

Further, even if the consumer were willing to change the battery once the low battery chirping began, the consumer may not have any batteries on hand. Indeed, such chirping will be particularly annoying if it begins just after a consumer returns from a store where they could have purchased batteries should they have known that the battery in the smoke detector was getting low. Currently, however, until a consumer returns to a store and purchases and installs new batteries, the low battery warning chirping will continue.

As a result, consumers have been known to remove the battery from the smoke detector, rendering it inoperative, until they have an opportunity to return to the store to purchase batteries. This leaves the consumer in a very dangerous situation where the smoke detector has been rendered inoperative simply for the sake of stopping the incessant low battery chirp from annoying the consumer. This dangerous situation will continue until a consumer purchases and replaces the battery. However, since the smoke detector is typically located on the ceiling as discussed above, the consumer may soon forget that it has been rendered inoperative.

There exists a need, therefore, for a system that allows the consumer to exercise some measure of control over the low battery warning of a smoke or other threat detector, but which will not allow the consumer to completely forget about the low battery condition that will eventually result in the disablement of the smoke or other threat detector.

BRIEF SUMMARY OF THE INVENTION

In view of the above, it is an object of the present invention to provide a new and improved appliance control network that allows a consumer to exercise a measure of control over a low battery warning of a smoke or other hazardous condition or threat detector. More particularly, it is an object of the present invention to provide a new and improved appliance control network that provides such control at an easily accessible location for all such detectors.

In a preferred embodiment of the present invention, the appliance control network allows a user to quiet the low battery chirp for a period of time. The network preferably displays a visual indication of the low battery warning so as to remind the consumer of this low battery condition. It is a further feature of the present invention that once the quiet time period of time has expired, the smoke or other threat detector will again produce the audible low battery chirp so as to remind the consumer of this continuing condition.

It is a feature of one embodiment of the present invention that the visual warning of the low battery condition be generated prior to the discharge of the battery to a point at which the detector will begin producing the audible chirp so that the consumer may prepare for the eventual low battery condition by purchasing batteries at their leisure. In this way, once the batteries have further discharged to the level at which the low battery warning will be produced, the consumer will have already purchased batteries so that the replacement thereof may take effect without further aggravation.

A further feature of an embodiment of the present invention includes automatic quieting of the low battery chirp during periods when such chirping will produce added annoyance in the consumer. Such periods include, for example, the night time sleeping hours, dinner time, etc. To accommodate different schedules of consumers, this feature also may include user programmability such that "quiet times" can be logged. During these quiet times the system of the present invention will quiet the low battery chirp signal without requiring user intervention. In one embodiment, the initial generation of such a chirp will be precluded.

In one embodiment of the present invention, the appliance control network utilizes an intelligent thermostat to provide the consumer control over the low battery chirp functions. This intelligent thermostat includes a user interface display on which warning and pre-warning messages may be displayed, and from which the quieting and automatic quieting features may be accessed. Communications circuitry in the intelligent thermostat and in each of the smoke or other threat detectors allows the low battery information and quieting control signals to be exchanged. The communications network over which such data is exchanged may be wired or wireless. The wired configurations include individual system wiring to each detector, the inclusion of a system BUS to which each of the detectors in the intelligent thermostat connect to exchange data, etc.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
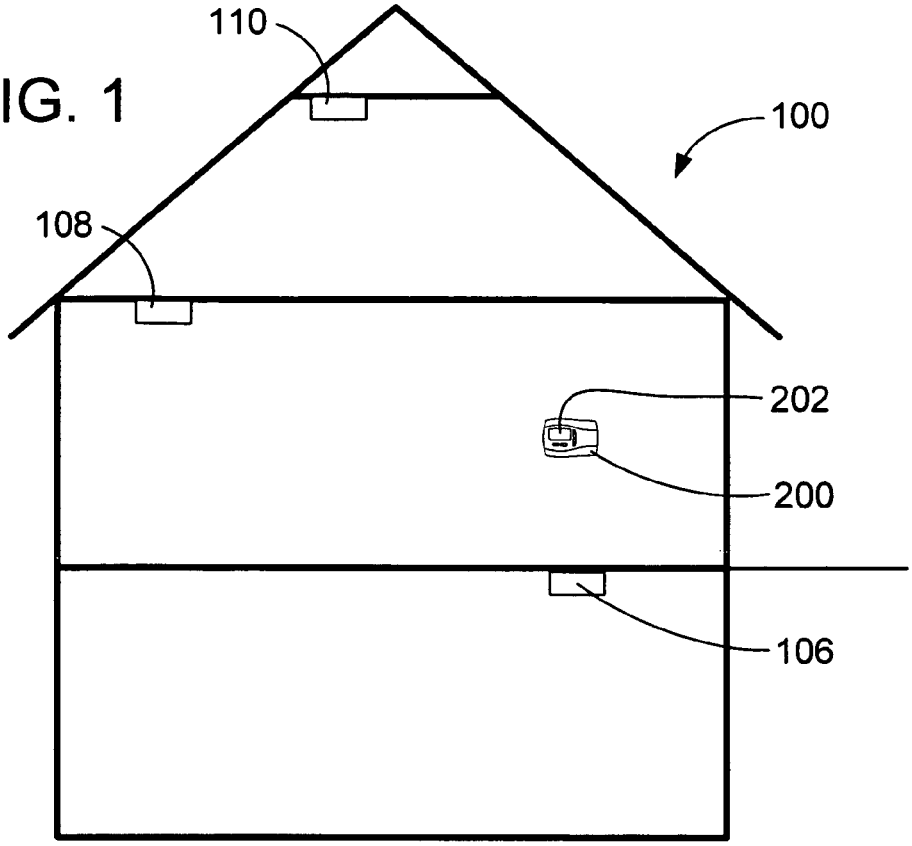
FIG. 1 is a simplified illustration of a home environment containing a plurality of consumer appliances in which the system of the instant invention is installed.

FIG. 1 illustrates a simplified home environment 100 into which the system of the present invention finds particular applicability. However, one skilled in the art will recognize that the system of the present invention is not limited to a home environment, but may also be installed in a commercial environment, etc. This typical home environment 100 includes an intelligent thermostat 200. As is typical, the thermostat 200 controls heating of the home environment 100 by a furnace (not shown), and possibly cooling of the home environment 100 by the air conditioning system (not shown). The interface to both the furnace and the air conditioning system is typically pre-wired in the home environment 100, although the communications control from the thermostat 200 may also be wireless as desired by providing receiver/transmitter circuitry in the furnace and/or the air conditioning system. Similar receiver/transmitter circuitry is also required in thermostat 200 to provide this communications capability.

In view of the recognition that smoke and other types of battery-powered threat detectors save lives, the typical home environment 100 also includes a plurality of such threat detectors 106, 108, 110 installed throughout. In accordance with the present invention, these detectors 106-110 include electronic circuitry that regulates its operation. With the provision of such electronic circuitry, communication circuitry may also now be included in these detectors 106-110 to allow coordinated operation, enhanced diagnostic features, and remote controllability. Preferably, such communication circuitry includes wireless receiver/transmitter circuitry. However, the system of the present invention also allows for wired communication with the appliances via discreet wires, or via a communications BUS to which the detector is attached as will be discussed more fully below. Through the provision of such communications, the system of the present invention is particularly enabled.

Specifically, the system of the present invention includes an intelligent thermostat 200 that is capable of receiving information from the detectors 106-110 located throughout the home environment 100. Such information may include threat warning notifications, diagnostic information, control signals, etc. As discussed above, one common diagnostic feature that is included in these detectors 106-110 is a low battery monitor. When any of the detectors 106-110 detect that it has a low battery condition, it typically begins to periodically chirp to notify the consumer that the battery needs to be replaced. As discussed above, however, such low battery conditions may occur at inopportune times for the consumer to change the battery, such as at night or just after the consumer has returned from the store where new batteries are sold. To minimize the annoyance of such conditions, the system of the present invention utilizes the intelligent thermostat 200 to allow the consumer to quiet the low battery warning chirping, to prevent the occurrence of such chirping during the nighttime hours, and even to provide a pre-notification before an actual low battery condition exists so that the consumer may better plan for such an event, all of which will be discussed in greater detail below.

In order to provide the low battery condition information to the thermostat 200 of the present invention, the information must be communicated from the threat detectors 106-110 to the thermostat 200. This transmission of information may be facilitated by a wired network connecting each of the detectors 106-110 to the thermostat 200. Other wired network structures may also be utilized, including the provision of a system BUS to which each of the detectors 106-110, or a combination thereof, and the thermostat 200 connect. As is well known in the art, information communicated on the system BUS includes address information identifying the source and/or destination of the information transmitted thereon. Such individual addressing is not typically required in the wired network whereby each individual detector 106, 108, and 110 is separately wired to the thermostat 200. Various other wired infrastructures could be utilized with the system of the present invention, and are considered within the scope thereof.

With the increasing use, sophistication, reliability, data rates, and security of wireless communication protocols, a preferred embodiment of the present invention utilizes wireless communication between the detectors 106-110 and thermostat 200 to communicate system information and control signals therebetween. However, it is recognized that not all of the detectors may include such wireless communications capability. Therefore, a preferred embodiment to the thermostat 200 of the present invention includes the capability to communicate both wirelessly and through a wired connection.

For the wireless communication, various wireless communication protocols and standards may be implemented depending upon the particular home environment 100 in which the system is to be installed. That is, while the Bluetooth wireless standard may be utilized in a very small environment, its range limitations may make it unsuitable for larger or typical home environments 100. However, there are numerous other wireless protocols that can be utilized to provide the wireless connectivity between the thermostat 200 and the detectors. These other wireless protocols include, but are not limited to, the 802.11 or 802.15 family of standards. While proprietary wireless protocols may also be utilized, the use of a standard wireless protocol ensures interoperability with detectors manufactured by different manufacturers.

Figure 2:
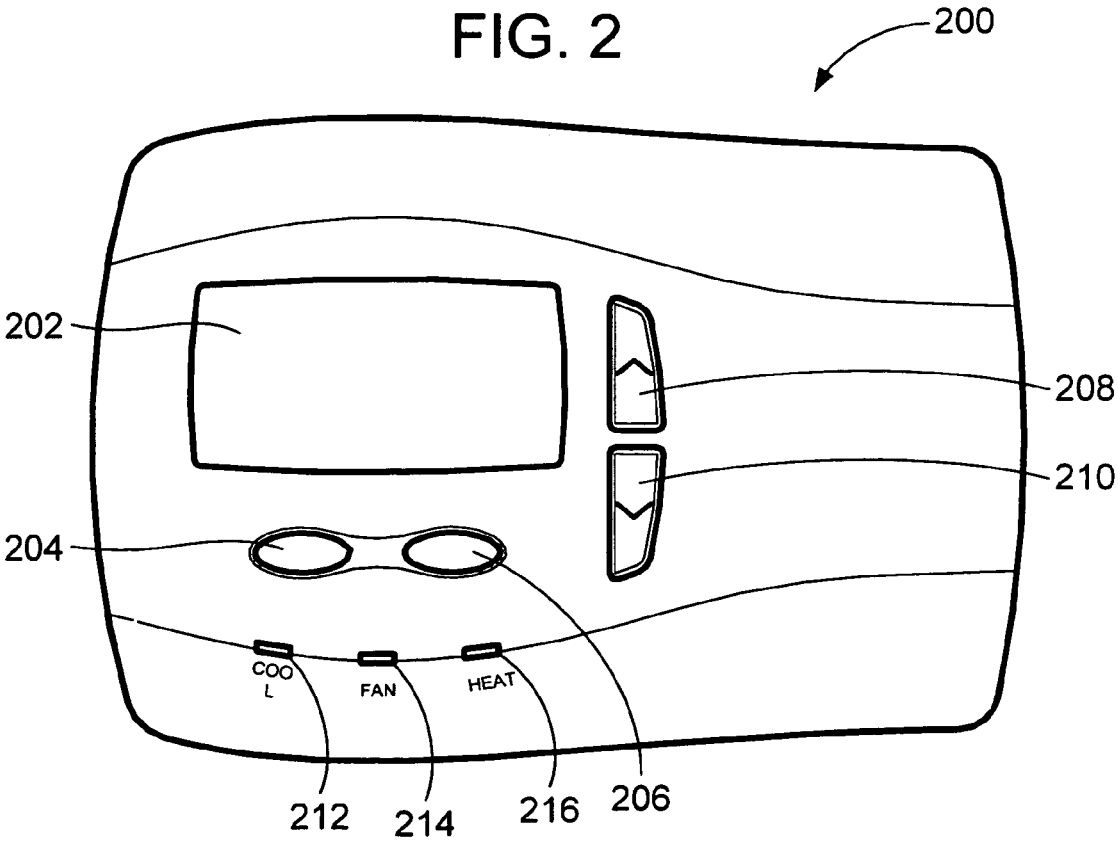
FIG. 2 is a front view illustration of one embodiment of an advanced thermostat constructed in accordance with the teachings of the present invention.

An embodiment of a thermostat constructed in accordance with the teachings of the present invention to incorporate the detector low battery warning control features of the invention is illustrated in FIG. 2. As may be seen from this FIG. 2, this embodiment of the thermostat 200 includes a user display 202 on which is typically displayed programmatic, system, and ambient information regarding the operation of the HVAC system with which it is typically associated. This user display 202 may take various forms as are well-known in the art, and in a preferred embodiment is a dot matrix LCD display.

With such a display 202, the consumer may activate various programmatic and control functions via a pair of soft keys 204, 206. The functionality executed by these soft keys 204, 206 varies dependent upon the programmatic state in which the thermostat 200 is at the time one of the soft keys 204, 206 is depressed. The particular functionality that will be instituted upon selection of one of the soft keys 204, 206 is displayed in an area of the user display 202 proximate the key 204, 206 which will institute that function. That is, the function that will be instituted upon selection of soft key 204 will be located generally in the lower left hand portion of user display 202 while the functionality that will be instituted by selection of soft key 206 will be located generally in the lower right hand portion of user display 202. These functional indicators may change depending on the program state and mode in which the thermostat is currently operating.

In addition to the soft keys 204, 206, this embodiment of the thermostat 200 of the present invention also includes adjustment keys 208, 210. These adjustment keys 208, 210 may serve to adjust a currently selected parameter up or down, such as in the case of setting the control temperature at which the thermostat will maintain the ambient environment. Additionally, these keys 208, 210 may scroll through the available data for a selected parameter, such as scrolling through alphanumeric data that may be selected for a given parameter. These keys 208, 210 may also function as soft keys depending on the programmatic state in which the thermostat is operating. When this functionality is provided, the function that will be instituted by selection of key 208 will be provided generally in the upper right hand corner of display 202, while the functionality that will be instituted by selection of key 210 will be displayed generally in the lower right hand corner of user display 202. In addition to the above, other user input means, such as an alphanumeric keypad, user rotatable knob, a touch screen, etc. may be utilized instead of the buttons 204-210 illustrated in the embodiment of FIG. 2.

In this embodiment, the thermostat 200 also includes operating mode visual indicators 212, 214, 216. These indicators 212-216 provide a visual indication of the current operating mode of the thermostat. In the embodiment illustrated in FIG. 2, indicator 212 will illuminate while the thermostat 200 is operating in the cooling mode. Indicator 216 will illuminate while the thermostat 200 is operating in the heating mode. Finally, indicator 214 will illuminate to indicate that the fan is operating. Depending on the particular application, this indicator 214 may illuminate whenever the fan is running, or may illuminate only when the fan is selected to run continuously.

In embodiments of the present invention that do not utilize automated switching control between the heating and cooling modes of operation, these indicators 212-216 may operate as user selectable switches to allow the consumer to select the operating mode of the thermostat 200. For example, during the summer months the consumer may select the cooling mode by depressing indicator 212. In this mode, the furnace will not be turned on even if the interior ambient temperature drops below the set point. To switch from the cooling to the heating mode of operation, the consumer, in this alternate embodiment, would need to select indicator 216 to allow the thermostat 200 to operate the furnace. Consumer selection in this embodiment of indicator 214 would operate the fan continuously, as opposed to its normal automatic operation based upon a call for cooling or heat by the thermostat 200. In a still further embodiment of the present invention, as will be discussed more fully below, the indicators 212-216 may also be utilized to provide a visual indication of system trouble or trouble with one of the appliances with which the thermostat 200 is in communication.

Having discussed the physical structure of one embodiment of an intelligent thermostat 200 constructed in accordance with the teachings of the present invention, the discussion will now focus on the operation of the system during detection of a low battery condition which forms an aspect of the present invention. Indeed, while the following discussion will utilize the structure of the thermostat 200 illustrated in FIG. 2, those skilled in the art will recognize that various other structures can be utilized without departing from the spirit and scope of the present invention. That is, regardless of the user input mechanisms utilized by the particular embodiment of the thermostat 200 of the present invention, the communications and programmatic steps provided in the following discussion may be used.

As discussed above, the electronic battery monitoring circuitry within the smoke or other threat detectors 106-110 generates a low battery warning which most often takes the form of a chirping sound periodically emitted by the detector. In the system of the present invention, recognizing the annoyance that such chirping can cause, the intelligent thermostat 200 serves as a central control point from which the user may exercise some measure of control over the low battery warning for each of the detectors in the dwelling. Specifically, each of the detectors 106-110 also includes communications circuitry to allow the detectors to transmit and/or receive information from the intelligent thermostat 200. In embodiments of the present invention, both battery strength information as well as control signals are exchanged between the detectors 106-110 and the thermostat 200, while other more simplified embodiments merely allow control signals to be transmitted from the thermostat 200 to the detectors 106-110 as will be discussed more fully below.

In the following discussion, the graph of FIG. 3 will be referenced to describe the various features of the present invention as they relate to a declining battery voltage 300 over time. As may be seen from this graphical illustration, normal operation of the detector results in a declining battery voltage over time. However, those skilled in the art will recognize that the curve 300 may not be truly representative of an actual battery discharge curve, but is presented in this manner to simplify the discussion and illustrate the various features of the present invention.

As discussed above, one aspect of consumer annoyance relates to the low battery warning chirping beginning at a time when it is not convenient for a consumer to rush out to the store to buy a new battery, or just after a consumer has returned from the store at which the consumer could have purchased a battery had they known that the battery in their detector was getting low. To overcome this aspect of annoyance, one embodiment of the system of the present invention utilizes a pre-warning voltage level $V_1$ to provide advance notice of the impending low battery condition so that the consumer may plan ahead to purchase batteries prior to an actual low battery condition being signaled.

Figure 3:
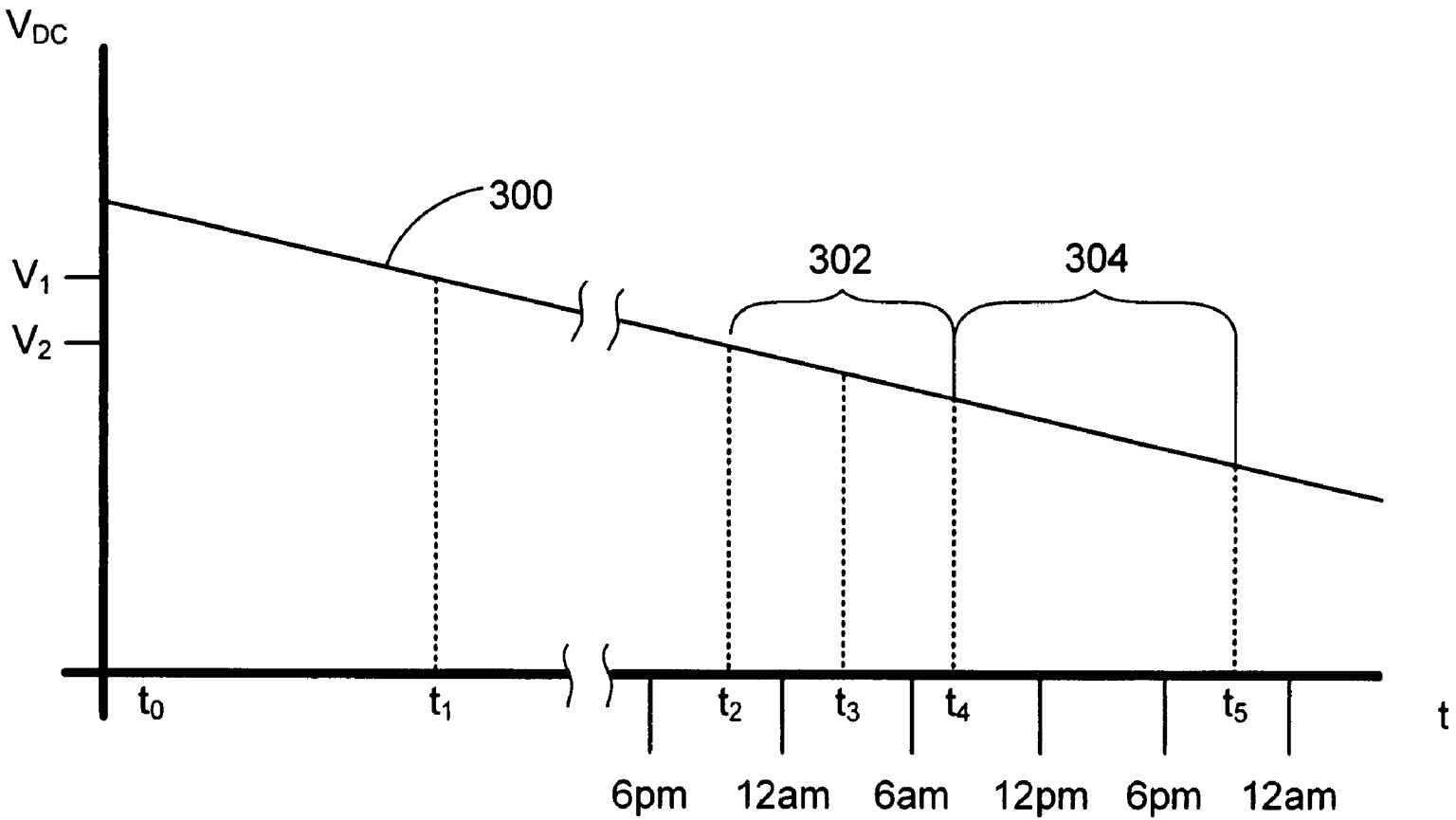
FIGS. 3-5 are graphical illustrations of exemplary low battery warning screens generated by an embodiment of the intelligent thermostat of the present invention.
Figure 4:
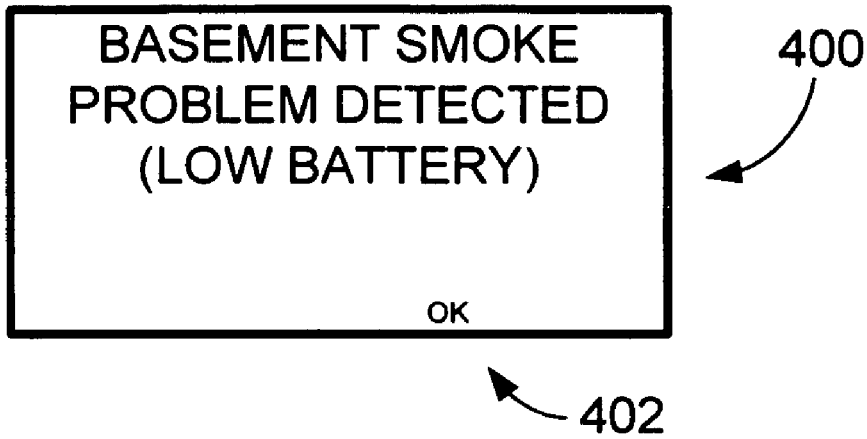

With reference to FIG. 3, as the battery voltage 300 declines within the detector, a point will be reached at time t, at which a pre-warning signal will be generated. Preferably, this pre-warning signal is transmitted from the detector to the thermostat 200. Upon receipt of this pre-warning signal, thermostat 200 will generate a low battery pre-warning signal. In a preferred embodiment, this pre-warning signal will be embodied in a visual display, such as the low battery warning screen 400 illustrated in FIG. 4. Preferably no audible alert will be generated so as to annoy the consumer. However, to draw attention to the visual pre-warning screen 400, the thermostat 200 may turn on the back light display, may flash the display, or may otherwise generate a visual cue that a message appears on the display 202 for the user attention.

Once the user has seen the warning screen 400, they may select soft key 206 corresponding to the O.K. function 402 to clear the warning screen from the thermostat 200. The voltage level $V_1$ at which such a pre-warring is generated may be chosen based upon a discharge rate of the particular detector, and will preferably provide at least one week's notice under normal discharge conditions for the pre-warning signal. Those skilled in the art will recognize, however, that shorter or longer periods of time may also be chosen as appropriate.

Also as discussed above, another source of annoyance of the low battery chirping is the occurrence of this chirping during periods when the user does not wish to be disturbed. These periods may include during dimmertime, during sleeping hours, during a baby's nap time, etc. To remove this source of annoyance, the system of the present invention provides the ability for users to select time periods during which a low battery warning will automatically be quieted so that the user will not be disturbed during these periods.

For example, as illustrated in FIG. 3, the user has selected the time period from 10:00 p.m. until 8:00 a.m. (period 302) as quiet time. That is, during this user selected quiet time any low battery warnings that may be generated will automatically be quieted so that the consumer is not disturbed during that period 302. As illustrated in FIG. 3, this quiet period 302 corresponds to the time period between time $t_2$ and $t_4$. However, as illustrated by the battery voltage discharge curve 300, the low battery voltage level $V_2$ is reached at a time $t_3$ during the quiet period 302. In this situation, the low battery warning will automatically be quieted until the expiration of the quiet period 302 at $t_4$. In a preferred embodiment, the detector will transmit a low battery warning signal to the thermostat 200 prior to generating any chirps. Once such a signal is received by the thermostat 200, the thermostat will check to see if the current time corresponds to a quite time. If so, the thermostat will transmit a quiet signal to the detector to preclude it from issuing a single chirp.

From the expiration of the quiet period at time $t_4$ until the starting of quiet time period at time $t_5$ defines a period of time 304 during which the low battery chirp will be allowed to be broadcast by the detector. However, while the low battery warning chirp may be enunciated during period 304, the user will also have the option to quiet the low battery warning chirp during this period by accessing the low battery warning screen 500 illustrated in FIG. 5. This low battery warning screen 500 is displayed on display 202 when the thermostat 200 receives the low battery warning signal transmitted from the appropriate detector.

Figure 5:
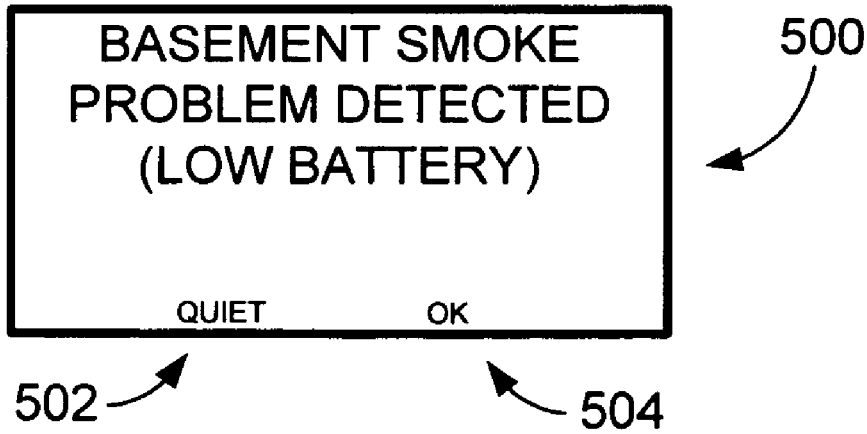

As may be seen from this FIG. 5, the low battery warning screen 500 displays information identifying which detector has issued the low battery warning. The low battery warning screen 500 also provides the ability for the user to quiet the low battery chirping by accessing soft key 204 corresponding to the quiet function 502. This quiet function 502 causes the thermostat 200 to transmit a quiet signal to the appropriate detector to silence or quiet the low battery chirping for a predetermined period of time. While various time periods may be utilized, a preferred embodiment of the present invention utilizes 6, 12, or 24 hour periods. If, instead, the user chooses to change the battery in the smoke detector, the user need only select soft key 206 corresponding to the O.K. function 504 to clear the warning screen 500 from the display 202 of thermostat 200.

While a preferred embodiment of the present invention utilizes the intelligent thermostat 200 to coordinate system operation as discussed above, this central control point need not be a thermostat. That is, the central control point could be a separate controller having a user interface whose functionality is limited to coordination of and communication with the components in the system. This separate controller may be a stand alone controller, may be a PC application, etc. Additionally, in embodiments of the present invention in which an intelligent thermostat provides this central control point, the user interface and the control portions of such a thermostat need not be integrated into a single housing. That is, the user interface may be mounted in a commonly user accessed area for convenience, while the control electronics could be located remotely from the user interface.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of remotely controlling low battery warnings of a hazardous condition detector, comprising the steps of:

receiving by a remotely located control point battery information from the hazardous condition detector;

transmitting by the remotely located control point a low battery warning hush signal to the hazardous condition detector to hush the low battery warning produced thereby.

2. The method of claim 1, further comprising the step of displaying by remotely located control point a visual indication of the low battery information.

3. The method of claim 2, wherein the step of receiving by the remotely located control point battery information comprises the step of receiving by the remotely located control point battery strength information, and wherein the step of displaying by the remotely located control point the visual indication comprises the step of displaying by the remotely located control point a low battery pre-warning visual indication.

4. The method of claim 3, wherein the step of displaying by the remotely located control point a low battery pre-warning visual indication includes the step of generating by the remotely located control point a visual cue to alert a user of the low battery pre-warning visual indication.

5. The method of claim 3, further comprising the step of comparing by the remotely located control point the battery strength information to a predetermined threshold, and wherein the step of displaying by the remotely located control point a low battery pre-warning visual indication occurs when the battery strength information indicates that the battery strength is below the predetermined threshold.

6. The method of claim 5, further comprising the step of setting the predetermined threshold to a level sufficient to provide approximately one week's notice before the hazardous condition detector sounds the low battery warning.

7. The method of claim 2, further comprising the step of receiving by the remotely located control point user input requesting the low battery warning be hushed.

8. The method of claim 1, wherein the step of transmitting by the remotely located control point the low battery warning hush signal continues for a hush period to continue to hush the low battery warning for the hush period.

9. A method of remotely controlling low battery warnings of a hazardous condition detector comprising the steps of:

receiving battery information from the hazardous condition detector;

transmitting a low battery warning hush signal to the hazardous condition detector to hush the low battery warning produced thereby; and establishing at least one quiet time during which no low battery warnings are to be sounded by the hazardous condition detector, and wherein the step of transmitting the low battery warning hush signal occurs automatically when the step of receiving low battery information occurs during the at least one quiet time.

10. The method of claim 9, wherein the step of establishing the at least one quiet time comprises the step of receiving user programming input identifying desired staffing and ending time for each of the at least one quiet time.

11. The method of claim 9, wherein the step of receiving low battery information from the hazardous condition detector comprises the step of receiving low battery information from the hazardous condition detector indicating that the hazardous condition detector is about to sound its low battery warning and wherein the step of automatically transmitting the low battery warning hush signal occurs before the hazardous condition detector sounds its low battery warning.

12. A method of remotely controlling low battery warnings of a hazardous condition detector, comprising the steps of:

monitoring a charge condition of a battery;

transmitting low battery information to a remotely located control point;

receiving a low battery hush signal from the control point; and hushing an audible low battery warning signal.

13. The method of claim 12, further comprising the step of generating the audible low battery warning signal until the step of receiving the low battery hush signal has occurred.

14. The method of claim 12, further comprising the step of generating the audible low battery warning signal after a predetermined period of time after the step of transmitting the low battery information has occurred when the step of receiving the low battery hush signal has not yet occurred.

15. The method of claim 12, wherein the step of transmitting low battery information comprises the step of transmitting battery strength information.

16. The method of claim 12, wherein the step of transmitting low battery information comprises the step of transmitting information indicating that a low battery condition has been detected.

17. The method of claim 12, further comprising the step of generating the audible low battery warning signal a predetermined length of time after the step of receiving a low battery hush signal.

18. The method of claim 12, further comprising the step of generating the audible low battery warning signal after the step of receiving a low battery hush signal no longer occurs.

19. A system for remotely controlling a low battery warning signal, comprising:

a hazardous condition detector having a battery and battery monitoring circuitry therein, the hazardous condition detector further including communication circuitry;

a thermostat including communications circuitry therein; and wherein the hazardous condition detector is configured to transmit battery information to the thermostat; and wherein the thermostat is configured to transmit a low battery warning hush signal to the hazardous condition detector to hush an audible low battery warning signal produced by the hazardous condition detector.

20. The system of claim 19, wherein the thermostat is programmable to establish at least one quiet time during which no audible low battery warning is to be sounded, wherein the hazardous condition detector is programmed to transmit the battery information to the thermostat before generating the audible low battery warning signal, and wherein the thermostat is programmed to automatically transmit the low battery warning hush signal to the hazardous condition detector when the battery information indicates that the audible low battery warning signal will be produced during the at least one quiet time.

* * * * *